US006908399B1

(12) United States Patent
Henry

(10) Patent No.: US 6,908,399 B1
(45) Date of Patent: Jun. 21, 2005

(54) GOLF CLUB SET

(75) Inventor: Randy Henry, Hayden Lake, ID (US)

(73) Assignee: Henry-Griffitts Inc., Hayden, ID (US)

( * ) Notice: Subject to any disclaimer, the term of this patent is extended or adjusted under 35 U.S.C. 154(b) by 0 days.

(21) Appl. No.: 09/360,881

(22) Filed: Jul. 23, 1999

(51) Int. Cl.[7] ..... A63B 53/04
(52) U.S. Cl. ..... 473/291
(58) Field of Search ..... 473/287, 288, 473/289, 290–291, 292, 345

(56) References Cited

U.S. PATENT DOCUMENTS 3,871,649 A * 3/1975 Kilshaw ..... 473/289
4,498,672 A * 2/1985 Bulla ..... 473/332
4,840,380 A * 6/1989 Kajita et al. ..... 273/77 A
4,874,171 A * 10/1989 Ezaki et al. ..... 473/290
5,121,918 A * 6/1992 Teramoto et al. ..... 473/290
5,295,686 A * 3/1994 Lundberg ..... 273/77 A
5,318,296 A * 6/1994 Adams et al. ..... 273/77 R
5,356,138 A * 10/1994 Chen et al. ..... 273/77 A
5,480,145 A * 1/1996 Sherwood ..... 273/77 A
6,071,198 A * 6/2000 Nishizawa et al. ..... 473/291
6,093,112 A * 7/2000 Peters et al. ..... 473/291

* cited by examiner

*Primary Examiner*—Stephen Blau
(74) *Attorney, Agent, or Firm*—John S. Reid

(57) ABSTRACT

A set of golf clubs wherein the club length varies between adjacent clubs in the set by at least about 0.6 inches (15.24 mm), and preferably about 0.75 inches (19 mm). Preferably, the lie angle between adjacent clubs in the set varies by greater than about 0.6 degrees, and preferably by about 0.75 degrees. More preferably, the club head weight varies between adjacent clubs in the set by at least about 8 grams, and preferably by between about 9 grams and 11 grams. The club length and lie angle of the 9-iron can approximately equivalent to the club length and lie angle of a prior art 9-iron. For a first standard set of clubs, the 1-iron has an exemplary club length of approximately 41.5 inches (105.4 mm), and the 9-iron has an exemplary club length of approximately 35.5 inches (90.17 mm). The 1-iron has an exemplary lie angle of approximately 57 degrees, while the 9-iron has an exemplary lie angle of approximately 63 degrees.

26 Claims, 3 Drawing Sheets

GOLF CLUB SET

FIELD OF THE INVENTION

This invention pertains to golf clubs, and in particular to a set of golf clubs having an increased range of club lengths.

BACKGROUND

A standard prior-art set of golf clubs typically includes a set of irons, as well as woods. The irons are typically numbered starting with 1 and increasing through 9, although many sets of golf clubs do not include a 1-iron or a 2-iron as standard. Also, many sets include only the odd numbered irons. Typically included with the irons are a pitching wedge, which follows the 9-iron, at least one sand wedge, which follows the pitching wedge, and a lob wedge, which follows the sand wedge(s). Of course, not all club sets include every listed club.

The golf clubs in a prior art set are differentiated from one another by the club length between adjacently numbered clubs of one-half inch or less. That is, as the number of the golf club gets higher, the length of the club gets shorter. Further, as the club number gets higher, the weight of the golf club head increases, and the lie angle of the club increases. The lie angle of prior art golf clubs increases by one-half of a degree between adjacent clubs. For example, a 5-iron has a lie angle of 61 degrees, while a 6-iron has a lie angle of 61.5 degrees. However, due to the difficulty of manufacturing a one-half degree lie angle, some manufacturers will only increase the lie-angle on every other club, in which case the increase is one degree on alternating clubs. For example, a 5-iron will have a lie angle of 61 degrees, a 6-iron will also have a lie angle of 61 degrees, while a 7-iron will have a lie angle of 62 degrees.

SUMMARY OF THE INVENTION

A set of golf clubs having a club length variance between adjacent clubs in the set of greater than about 0.6 inches (15.24 mm), and preferably about 0.75 inches (19 mm). The club length and lie angle of the 9-iron can be approximately equivalent to the club length and lie angle of a prior art 9-iron. For a first standard set of clubs, the 1-iron has an exemplary club length of approximately 41.5 inches (105.4 mm), while the 9-iron has an exemplary club length of approximately 35.5 inches (90.17 mm). Preferably, the lie angle varies between adjacent clubs in the set by greater than about 0.6 degrees, and preferably by about 0.75 degrees. The 1-iron has an exemplary lie angle of approximately 57 degrees, while the 9-iron has an exemplary lie angle of approximately 63 degrees.

Preferably, the golf club set of the present invention further includes a club head weight variance between adjacent clubs in the set of approximately 8 or more grams, and preferably about 9 grams or more.

DESCRIPTION OF PREFERRED EMBODIMENTS OF THE INVENTION

Figure 1:
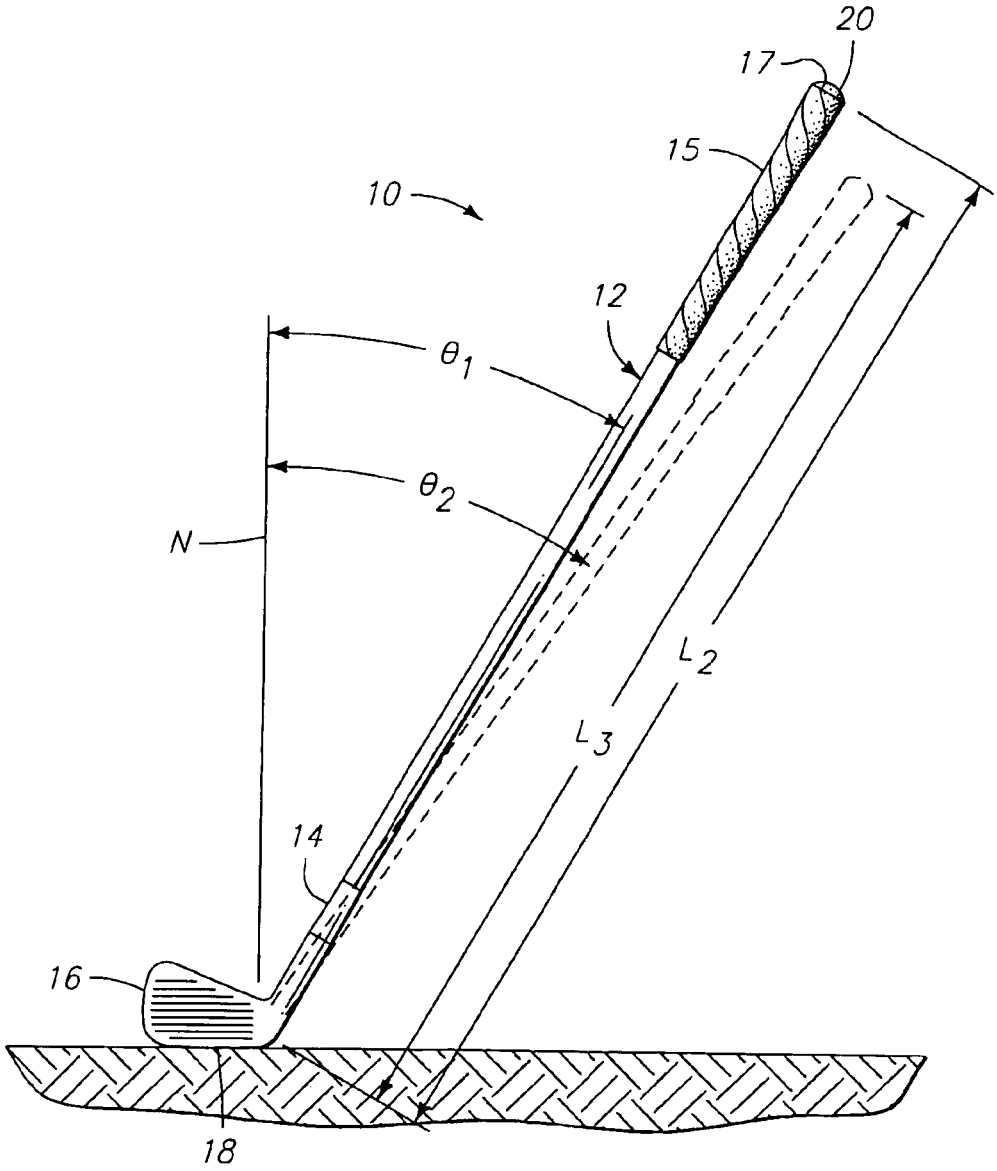
FIG. 1 is a drawing of a 5-iron golf club from a set of clubs of the present invention, showing the club length and lie angle of the club.

Prior art sets of golf clubs have a standard club length variance of about 0.5 inches (12.2 mm) or less between adjacent clubs in the set, and a lie angle variance of about 0.5 degrees between adjacent clubs. Alternately, prior art golf club sets can have a lie angle variance of about 1 degree between every other club in the set, with no lie angle variance between alternating adjacent clubs, as described more fully above. Additionally, prior art golf clubs have a head weight difference of about 6 to 7 grams between adjacent clubs. By "adjacent clubs" or "adjacently sequenced golf clubs" I mean the clubs that are normally in immediate, sequential series with one another in a set of golf clubs. For example, the adjacent clubs to a 5-iron are the 4-iron and the 6-iron. A first standard full set of golf clubs typically includes sequentially adjacent numbered irons 1 through 9, continuing with a respective sequentially adjacent pitching wedge or wedges, a sand wedge, and a lob wedge. Sets of clubs less than a full set typically include alternating sequentially clubs, for example, irons 3, 5, 7 and 9, and may exclude or more of the clubs following the 9-iron, such as the lob wedge and a second pitching wedge.

I have found that by increasing the club length variance between adjacent clubs in a set of golf clubs, a golfer's performance can be improved. The invention thus includes a set of golf clubs having a greater range of club lengths than prior art golf club sets. The club lengths of a set of golf clubs of the present invention generally vary by greater than about 0.6 inches (15.24 mm) between adjacent clubs in the set. Preferably, the club lengths generally vary by between about 0.6 inches (15.24 mm) and 1 inch (25.4 mm) between adjacent clubs in the set. More preferably, the club lengths vary by about 0.75 inches (19.05 mm) between adjacent clubs in the set. A set of golf clubs in accordance with the present invention can be further advantageously provided with a greater variance in club head weights between adjacent golf clubs over the prior art, as described more fully below. In addition, a set of golf clubs in accordance with the present invention can be further advantageously provided with a greater variance in lie angles between adjacent golf clubs over the prior art, as also described more fully below. In the preferred embodiment, a set of golf clubs in accordance with the present invention includes all three of these aspects, although the invention is not to be limited to such an embodiment.

The set of clubs in accordance with the present invention can include alternating sequential adjacent clubs as well. When the set of clubs includes alternating sequential adjacent clubs, the club lengths vary by greater than about 1.2 inches (30.4 mm) between alternating sequential adjacent clubs in the set. Preferably, the club lengths generally vary by between about 1.2 inches (30.424 mm) and 2 inches (50.8 mm) between alternating sequential adjacent clubs in the set. More preferably, the club lengths vary by about 1.5 inches (38.1 mm) between alternating sequential adjacent clubs in the set.

The set of golf clubs in accordance with the present invention also preferably has a greater range of lie angles than prior art golf sets to account for the greater range of club lengths. The lie angle in the set of golf clubs of the present invention varies by greater than about 0.6 degrees between immediately adjacent clubs in the set. Preferably, the lie angle varies between about 0.6 degrees and 1 degree between immediately adjacent clubs in the set. More preferably, the lie angle varies by about 0.75 degrees between immediately adjacent clubs in the set.

When the set of clubs includes alternating sequential adjacent clubs, the lie angles vary by greater than about 1.2 degrees between alternating sequential adjacent clubs in the set. Preferably, the lie angles generally vary by between about 1.2 degrees and 2 degrees between alternating sequential adjacent clubs in the set. More preferably, the lie angles vary by about 1.5 degrees between alternating sequential adjacent clubs in the set.

The set of golf clubs in accordance with the present invention more preferably has a greater club head weight difference between immediately adjacent clubs in the set than prior art golf club sets to account for the greater range of club lengths. The difference in club head weight of between immediately adjacent clubs in the set golf clubs of the present invention is approximately 8 or more grams, and preferably about 9 grams or more. A first set of golf clubs in accordance with the present invention has a head weight variance between adjacent clubs in the set of approximately 9 grams. A second set of golf clubs in accordance with the present invention has a head weight variance between adjacent clubs of approximately 10 grams, while a third set of clubs in accordance with the present invention has a head weigh variance of approximately 11 grams between adjacent clubs. Turning to FIG. 1, a 5-iron 10 from a set of golf clubs in accordance with the present invention is shown. The club length is defined as the length $L_2$ from the ground to the end 17 of the shaft 12 with the club lying in its natural position, which is determined by the geometry of the club head 16 and the sole 18. The club length does not include the end-cap 20. The lie angle θ is defined as the angle between the centerline of the shaft 12 and a vertical line N. The difference between a golf club from a set of clubs in accordance with the present invention and a prior art golf club is also depicted in FIG. 1. The length $L_2$ of the 5-iron 10 of the present invention is 38.5 inches (97.8 mm), as compared to the length $L_3$ of a prior art 5-iron, which is 37.5 inches (95.3 mm) for a comparable set of golf clubs. Further, the lie angle $\theta_1$ of the 5-iron 10 is 60 degrees, compared to the lie angle $\theta_2$ of a prior art 5-iron art, which is 61 degrees.

Figure 2:
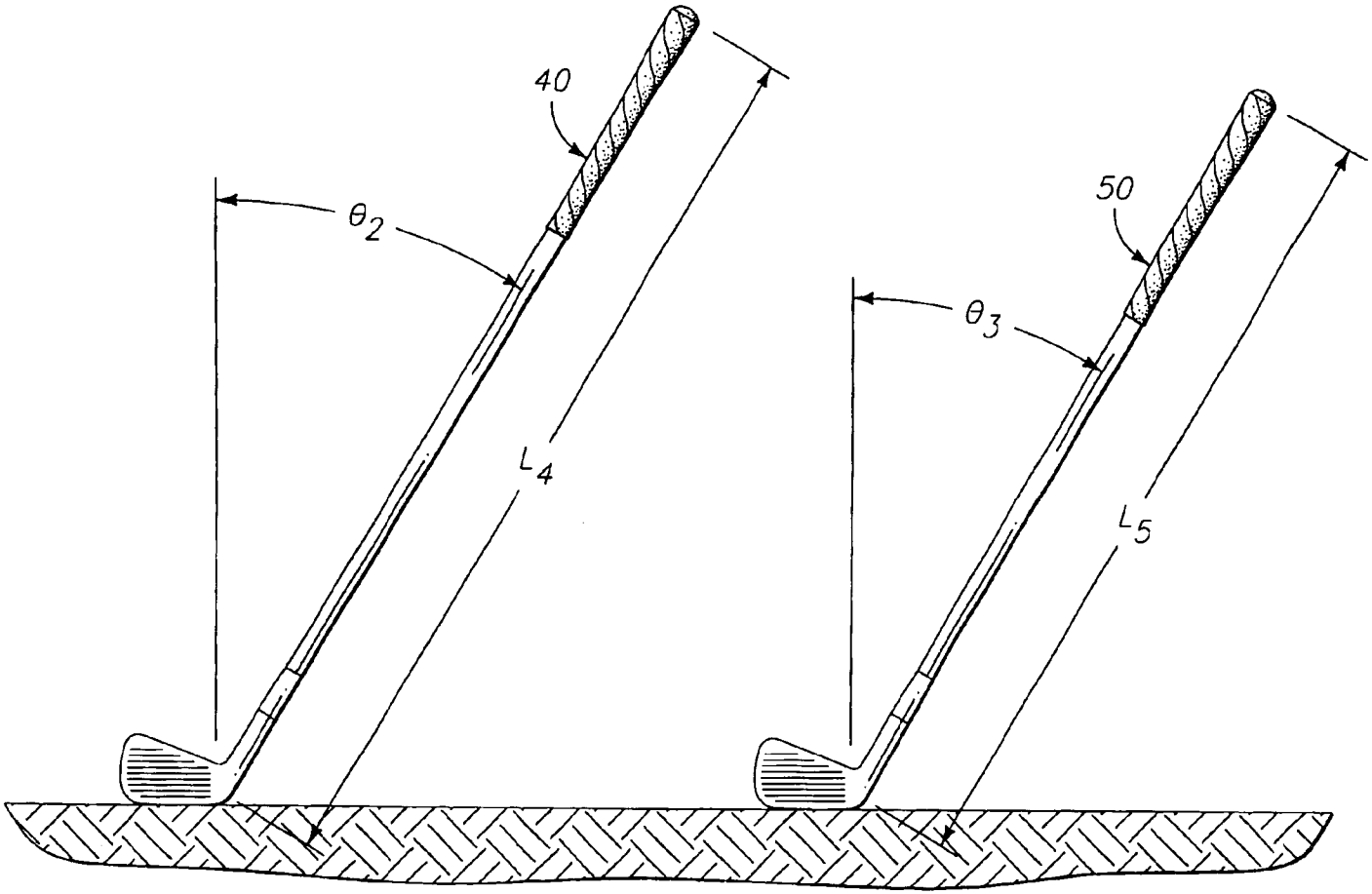
FIG. 2 is a drawing of a 5-iron and a 4-iron from a set of golf clubs in accordance with the present invention.
Figure 3:
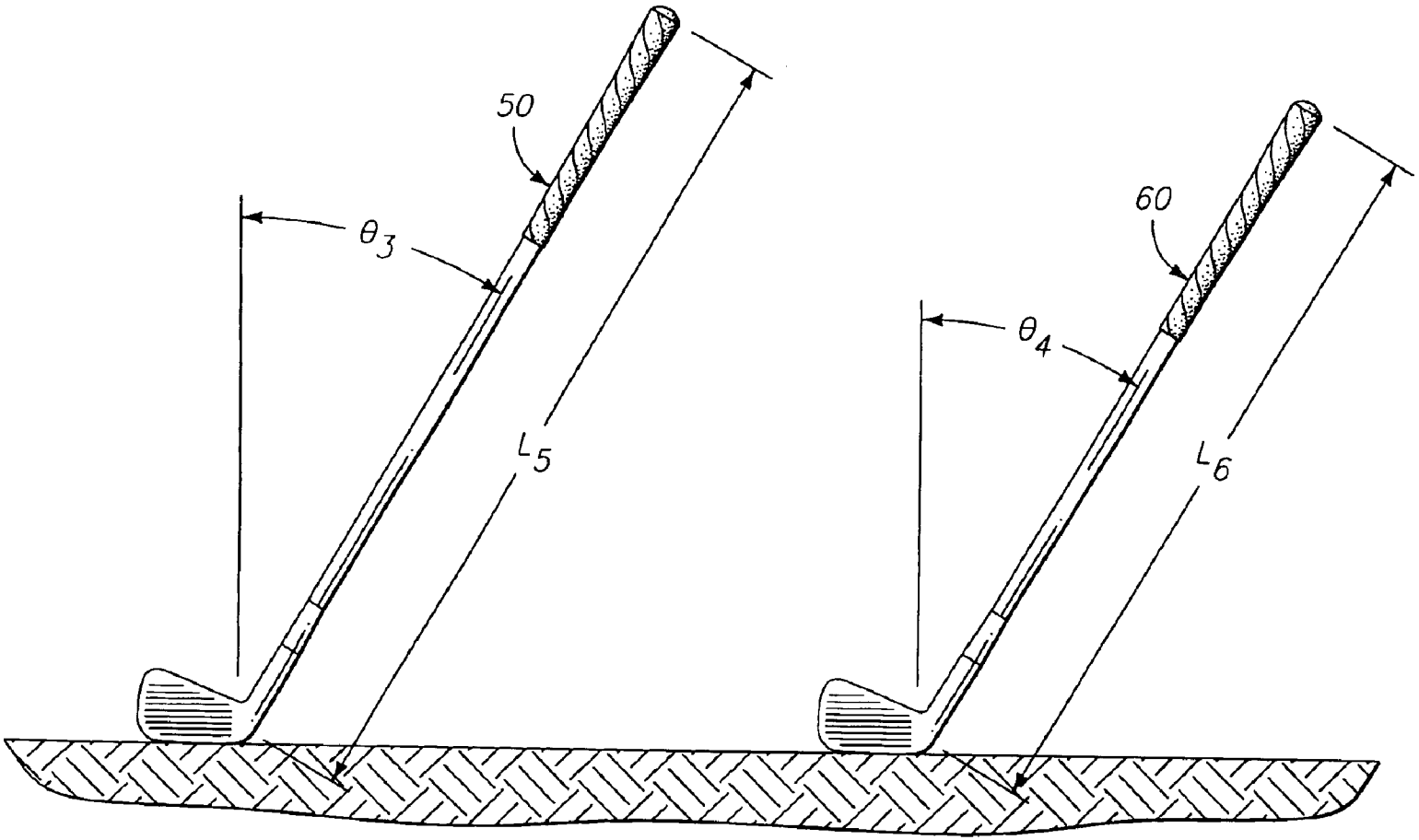
FIG. 3 is a drawing of a 5-iron and a 6-iron from a set of golf clubs in accordance with the present invention.

The difference between adjacent golf clubs in a set of clubs in accordance with the present invention is shown in FIGS. 2 and 3. FIG. 2 depicts exemplary golf clubs of the present invention comprising a 4-iron 40 and a 5-iron 50. The 4-iron 40 has a club length $L_4$ of 39.25 inches (99.7 mm), while the 5-iron 50 has a club length $L_5$ of 38.5 inches (97.8 mm). In addition, the 4-iron has a lie-angle $\theta_2$ of 59.25 degrees, and the 5-iron has a lie angle $\theta_3$ of 60 degrees. By comparison, a prior art 4-iron has a club length of 38 inches (96.5 mm) and a lie angle of 60.5 degrees, while a prior art 5-iron has a club length of 37.5 inches (95.25mm) and a lie angle of 61 degrees.

FIG. 3 depicts exemplary golf clubs of the present invention comprising the 5-iron 50 of FIG. 3, and a 6-iron 60. The dimensions of the 5-iron are given above. The 6-iron 60 has a club length $L_6$ of 37.75 inches (95.9 mm) and a lie-angle $\theta_4$ of 60.75 degrees. By comparison, a prior art 6-iron has a club length of 37 inches (94.0 mm) and a lie angle of 61.5 degrees.

A set of golf clubs in accordance with the present invention can comprise a pitching wedge which is adjacent in series to the 9-iron, as well as a first sand-wedge, such that the adjacent clubs in the set comprise an 8-iron, a 9-iron, a pitching wedge, and a first sand wedge. The set of clubs can further include a second sand wedge and a lob wedge, in sequence following the first sand wedge, as indicated in Table I. Preferably, there is no club length difference between the 9-iron, the pitching wedge and the first sand wedge, and the lie angle and head weight of the three clubs are the same. However, the pitching wedge has a greater loft to the face of the club than does the 9-iron by about 4 degrees. Likewise, the first sand wedge has a greater loft to the face of the club head than the does pitching wedge by about 4 degrees. This is indicated in Table II.

The second sand wedge and the lob wedge have shaft lengths shorter than the 9-iron through first sand wedge by about 0.5 inches (12.9 mm). The lie angles of the second sand wedge and the lob wedge are greater by about 0.6 degrees greater than the lie angles of the 9-iron through first sand wedge, and more preferably by about 0.75 degrees. Further, the club head weights of the second sand wedge and the lob wedge are greater than the head weights of the 9-iron through the first sand wedge by about 10 grams. Preferably, there is no club length difference between the second sand wedge and the lob, and the lie angle and head weight of the two clubs are the same. However, the second sand wedge has a greater loft to the face of the club than does the first sand wedge by about 4 degrees, and the lob wedge has a greater loft to the face of the club than does the second sand wedge also by about 4 degrees. Table II indicates these differences and similarities between the 9-iron through the lob wedge in a set of clubs of the present invention. Thus, in a complete set of clubs in accordance with the present invention, the variance in club length, lie angle and head weight are not necessarily the same from club to club, particularly at the short end of the range (i.e., from the 9-iron through the lob wedge). Accordingly, it is not necessary that all clubs in a set of clubs in accordance with the present invention have shaft length variances of about 0.75 inches (19.05 mm), or lie angle variances of about 0.75 degrees, or head weight variances of greater than about 8 grams between adjacent clubs. It is sufficient that only selected adjacent clubs in the set have one or more of these variances.

Certain golfers perform better with a club length that is different than a standard length. Such typically accounts for the height of the golfer—taller golfers requiring longer clubs ("over-sized" or "plus" clubs), while shorter golfers require shorter clubs ("under-sized" or "minus" clubs). However, the club-to-club variation typically remains unchanged. That is, in the prior art, a first non-standard set of golf clubs can have club lengths 1 inch longer than a standard set, yet the variation in length between the clubs in such a non-standard set remains the same. An aspect of the present invention is providing a non-standard set of clubs having club lengths different than a nominal or standard set of golf clubs in accordance with the present invention, but still having a variation in club length between adjacent clubs of greater than about 0.6 inches (15.2 mm), and more preferably a variation in club length between adjacent clubs of about 0.75 inches (19.1 mm).

In addition to having a greater range of club lengths and lie angles than do prior art golf club sets, a set of golf clubs in accordance with the present invention cari comprise a greater range of head weights than clubs of the prior art. Prior art golf club heads for irons increase by about 6 grams between adjacent clubs starting with the 1-iron through the 4-iron, and by about 7 grams between adjacent clubs starting with the 5-iron through the 9-iron. A further aspect of the present invention includes increasing the club head weight of adjacent golf clubs in a set of clubs by about 8 grams or more between adjacent clubs. Preferably, the weight is increased across a portion of the range of clubs, starting with the 1-iron through the 9 iron. More preferably, the club head weight is increased by between about 9 grams and 11 grams between adjacent clubs. For example, a prior art 1-iron has a club head weight of about 231 grams, and a prior art 2-iron has a club head weight of about 237 grams. By comparison, a 1-iron and a 2-iron in accordance with the present invention have club head weights of 206 and 217 grams, respectively.

It is understood that the club weights given in the above paragraph are exemplary only. For example, the 1-iron of the present invention can have a club head weight of about 200 grams, while the 2-iron will have a club head weight of about 211 grams. In either instance, the variation in club head weight between adjacent clubs in a set of clubs in accordance with the present invention varies by about 8 grams or more between selected adjacent clubs in the set.

EXAMPLE

Tables I and II below give exemplary values for three standard sets of golf clubs in accordance with the present invention. Table I is a table for a first standard set of clubs including a 1-iron through a 9-iron, and including a pitching wedge, a first and second sand wedge, and a lob wedge. Table I compares the shaft lengths, lie angles, and head weight for this first set of clubs to a prior art set of comparable golf clubs. Table II is a table for a second and third standard set of clubs including a driver similar to those shown in Table I, except that in the second set of clubs the head weigh variance between selected clubs is 10 grams, and in the third set of clubs the head weight variance between selected clubs is 11 grams.

It is understood that a set of golf clubs of the present invention does not need to include all of the clubs in what is generally known to be a complete set of clubs, as represented in the tables, or that the variances indicated herein must be applied to each and every adjacent club in the set. A set of golf clubs in accordance with the present invention can include as few as two golf clubs. Further, it is understood that the exact numerical values shown in the tables are exemplary only, and that the tables do not reflect over- or under-sized golf club sets, nor the range of club head weights which may be selected by a particular golfer for a particular club. The tables do however demonstrate the desirable variation in club length, lie angle, and head weight between adjacent golf clubs in the set.

TABLE I

A FIRST STANDARD SET OF GOLF CLUBS OF THE PRESENT INVENTION, AS COMPARED TO A FIRST STANDARD SET OF PRIOR ART GOLF CLUBS

| Club No. | Club length inches (mm) | Prior Art Club length inches (mm) | Lie angle (degrees) | Prior art Lie angle (degrees) | Club head Weight (grams) | Prior art Club head weight (gm) |
|---|---|---|---|---|---|---|
| 1-iron | 41.5 (105.4) | 39.5 (100.3) | 57 | 59 | 208 | 231 |
| 2-iron | 40.75 (103.5) | 39 (99.1) | 57.75 | 59.5 | 217 | 237 |
| 3-iron | 40 (101.6) | 38.5 (97.8) | 58.5 | 60 | 226 | 243 |
| 4-iron | 39.25 (99.7) | 38 (96.5) | 59.25 | 60.5 | 235 | 249 |
| 5-iron | 38.5 (97.8) | 37.5 (95.3) | 60 | 61 | 244 | 256 |
| 6-iron | 37.75 (95.9) | 37 (94.0) | 60.75 | 61.5 | 253 | 263 |
| 7-iron | 37 (94.0) | 36.5 (92.7) | 61.5 | 62 | 262 | 269 |
| 8-iron | 36.25 (92.1) | 36 (91.4) | 62.25 | 62.5 | 271 | 276 |
| 9-iron | 35.5 (90.2) | 35.5 (90.2) | 63 | 63 | 280 | 284 |
| Pitching Wedge | 35.5 (90.2) | 35.5 (90.2) | 63 | 63 | 280 | 285 |
| Sand wedge-1 | 35 (88.9) | 35.5 (90.2) | 63 | 63.5 | 280 | 296 |
| Sand wedge-2 | 35 (88.9) | 35 (88.9) | 63.75 | | 290 | |
| Lob wedge | 35 (88.9) | 35 (88.9) | 63.75 | | 290 | |

TABLE II

A SECOND AND THIRD STANDARD SET OF GOLF CLUBS OF THE PRESENT INVENTION

| Club No. | Club length inches (mm) | Lie angle (degrees) | Club head Weight of 2nd set (grams) | Club head Weight of 3rd set (gm) |
|---|---|---|---|---|
| 1-iron | 41.5 (105.4) | 57 | 202 | 200 |
| 2-iron | 40.75 (103.5) | 57.75 | 215 | 211 |
| 3-iron | 40 (101.6) | 58.5 | 225 | 222 |
| 4-iron | 39.25 (99.7) | 59.25 | 235 | 233 |
| 5-iron | 38.5 (97.8) | 60 | 245 | 244 |
| 6-iron | 37.75 (95.9) | 60.75 | 255 | 255 |
| 7-iron | 37 (94.0) | 61.5 | 265 | 266 |
| 8-iron | 36.25 (92.1) | 62.25 | 275 | 277 |
| 9-iron | 35.5 (90.2) | 63 | 285 | 288 |
| Pitching Wedge | 35.5 (90.2) | 63 | 285 | 288 |
| Sand wedge-1 | 35 (88.9) | 63 | 285 | 288 |
| Sand wedge-2 | 35 (88.9) | 63.75 | 295 | 299 |
| Lob wedge | 35 (88.9) | 63.75 | 295 | 299 |

While the above invention has been described with particularity to specific embodiments and examples thereof, it is understood that the invention comprises the general novel concepts disclosed by the disclosure provided herein, as well as those specific embodiments and examples.

I claim:

1. A set of golf clubs comprising a plurality of adjacent consecutively numbered irons, wherein between any two adjacent consecutively numbered irons of the set, a first iron has a club length of at least 0.6 inches longer than a second adjacent iron and the second adjacent iron has a lie angle of at least 0.6 degrees greater than the first iron and wherein the second adjacent iron has a club head weight at least 8 grams greater than the first iron wherein said set has five or more said adjacent consecutively numbered irons.

2. The set of golf clubs of claim 1 wherein the first iron has a club length no greater than about 1 inch longer than the second adjacent iron.

3. The set of golf clubs of claim 1 wherein the first iron has a club length of about 0.75 inches longer than the second adjacent iron.

4. The set of golf clubs of claim 1 further comprising at least a third consecutively numbered iron adjacent to the second iron wherein the second iron has a club length which is greater than 0.72 inches longer than the third iron.

5. The set of golf clubs of claim 4 wherein the third adjacent iron has a lie angle at least 0.6 degrees greater than the second adjacent iron.

6. The set of golf clubs of claim 4 wherein the third iron has a club head weight of at least about 9 grams greater than the second iron.

7. The set of golf clubs of claim 1 wherein the difference in head weight between the first iron and the second adjacent iron is at least about 9 grams.

8. The set of golf clubs of claim 1 wherein the second adjacent iron has a club head weight between 8 grams and about 12 grams greater than the first iron.

9. The set of golf clubs of claim 1 wherein the difference in club length between the first iron and the second adjacent iron is at least 0.72 inches.

10. The set of golf clubs of claim 1 wherein the difference in lie angle between the first golf club and the second adjacent iron is at least about 0.75 degrees.

11. The set of golf clubs of claim 1 wherein the second adjacent iron has a lie angle about 0.75 degrees greater than the first iron.

12. The set of golf clubs of claim 1 wherein the set further comprises at least one sequentially adjacent wedge iron.

13. The set of golf clubs of claim 1 wherein the sequentially adjacent wedge iron is selected from the group consisting of: a pitching wedge, a sand wedge, and a lob wedge.

14. A set of golf clubs comprising a plurality of alternating sequential adjacent irons, wherein between any two alternating sequential adjacent irons of the set, a first alternating sequential adjacent iron has a club length of at least 1.2 inches longer than a second alternating sequential adjacent iron and the second alternating sequential adjacent iron has a lie angle of at least 1.2 degrees greater than the first alternating sequential adjacent iron and wherein the second alternating sequential adjacent iron has a club head weight at least 16 grams greater than the first alternating sequential adjacent iron wherein said set has four or more said alternating sequential adjacent irons.

15. The set of golf clubs of claim 14 wherein the first alternating sequential adjacent iron has a club length no greater than about 2 inches longer than the second alternating sequential adjacent iron.

16. The set of golf clubs of claim 14 wherein the first alternating sequential adjacent iron has a club length of about 1.5 inches longer than the second alternating sequential adjacent iron.

17. The set of golf clubs of claim 14 further comprising at least a third alternating sequential adjacent iron wherein the second alternating sequential adjacent iron has a club length which is greater than 1.44 inches longer than the third alternating sequential adjacent iron.

18. The set of golf clubs of claim 17 wherein the third alternating sequential adjacent iron has a lie angle at least 1.2 degrees greater than the second alternating sequential adjacent iron.

19. The set of golf clubs of claim 17 wherein the third alternating sequential adjacent iron has a club head weight of at least about 18 grams greater than the second alternating sequential adjacent iron.

20. The set of golf clubs of claim 14 wherein the difference in head weight between the first alternating sequential adjacent iron and the second alternating sequential adjacent iron is at least about 18 grams.

21. The set of golf clubs of claim 14 wherein the second alternating sequential adjacent iron has a club head weight between 16 grams and about 24 grams greater than the first alternating sequential adjacent iron.

22. The set of golf clubs of claim 14 wherein the difference in club length between the first alternating sequential adjacent iron and the second alternating sequential adjacent iron is at least 1.44 inches.

23. The set of golf clubs of claim 14 wherein the difference in lie angle between the first alternating sequential adjacent iron and the second alternating sequential adjacent iron is at least about 1.5 degrees.

24. The set of golf clubs of claim 14 wherein the second alternating sequential adjacent iron has a lie angle about 1.5 degrees greater than the first alternating sequential adjacent iron.

25. The set of golf clubs of claim 14 wherein the set further comprises at least one consecutive sequentially adjacent wedge iron.

26. The set of golf clubs of claim 14 wherein the wedge iron is selected from the group consisting of: a pitching wedge, a sand wedge, and a lob wedge.

* * * * *